US005918491A

United States Patent [19]

Maxwell et al.

[11] Patent Number: 5,918,491

[45] Date of Patent: Jul. 6, 1999

[54] LOCKING ENCLOSURE FOR VENDING MACHINES

[76] Inventors: Daniel H. Maxwell, 2450 Vandermere Dr., Fayetteville, N.C. 28304; Henley S. Hales, Rt. 3 Box 86, Roseboro, N.C. 28382

[21] Appl. No.: 08/761,840

[22] Filed: Dec. 9, 1996

Related U.S. Application Data

[63] Continuation of application No. 08/478,339, Jun. 7, 1995, abandoned.

[51] Int. Cl.[6] ..... B65D 55/14

[52] U.S. Cl. ..... 70/164; 70/163; 70/158

[58] Field of Search ..... 70/164, 163, 166, 70/167, 18, 170, 171, 172, 173, 158

[56] References Cited

U.S. PATENT DOCUMENTS

| | | | |
|---|---|---|---|
| 105,691 | 7/1870 | Ingels | 70/40 |
| 1,271,096 | 7/1918 | Stewart et al. | 70/166 |
| 1,490,453 | 4/1924 | Caldwell | 70/40 |
| 2,604,259 | 6/1952 | Anderson | 70/173 |
| 3,083,896 | 4/1963 | Cairelli et al. | 70/163 |
| 3,391,256 | 7/1968 | Nawman | 379/445 |
| 4,300,373 | 11/1981 | Camos et al. | 70/232 |
| 4,305,231 | 12/1981 | Rasmussen | 51/3 |
| 4,406,358 | 9/1983 | Zahradnik | 194/1 A |
| 4,613,109 | 9/1986 | Boscacci | 248/553 |
| 4,669,281 | 6/1987 | Young | 70/57 |
| 4,683,734 | 8/1987 | Peterson | 70/163 |
| 4,709,897 | 12/1987 | Mooney | 248/551 |
| 4,953,374 | 9/1990 | Wiebe | 70/416 |
| 4,998,423 | 3/1991 | Hsu | 70/40 |
| 5,044,180 | 9/1991 | Lebrecht | 70/48 |
| 5,359,868 | 11/1994 | Villani | 70/203 |
| 5,397,176 | 3/1995 | Allen et al. | 312/223.2 |

FOREIGN PATENT DOCUMENTS

| | | | |
|---|---|---|---|
| 8900419 | 2/1989 | Netherlands | 70/167 |

*Primary Examiner*—Steven N. Meyers
*Assistant Examiner*—Tuyet-Phuong Pham
*Attorney, Agent, or Firm*—Mills & Associates

[57] ABSTRACT

This invention is a tamper-resistant enclosure for a coin-operated vending apparatus and the like wherein the locking device is fixedly attached to and mounted internally of the enclosure making it less vulnerable to theft and vandalism. The locking mechanism includes a ring-shaped hanging lock that is attached by weldment to an interior end wall of the enclosure. The lock is positioned in substantial alignment with an aperture in the front end wall to permit operation of the lock from the exterior of the enclosure by a key. The top cover includes an integrally formed locking flange which passes through a slotted opening in the end wall adjacent the lock such that the lock is positioned in an operative relationship with an aperture in the locking flange when the slideable top is in a closed position enabling the enclosure to be secured. The enclosure is adaptable to use for vending any suitable consumer product or to any application where a secure, corrosion-resistant enclosure is desired.

9 Claims, 3 Drawing Sheets

LOCKING ENCLOSURE FOR VENDING MACHINES

This application is a continuation, of application number 08/478,339 filed Jun. 7, 1995, now abandoned.

FIELD OF INVENTION

This invention relates to locking enclosure and more particularly to locking enclosures for vending equipment and the like.

BACKGROUND OF INVENTION

Locking enclosures for vending equipment are well known in a variety of commercial settings. A coin-operated vending apparatus and the particular consumer product are typically protected within the confines of a sheet metal enclosure having a locking mechanism.

In recent years with the advent of self-service gasoline stations, a variety of coin-operated, compressed air vending machines have been introduced for the convenience of the consumer. The coin-operated controls and compressor for the air vending apparatus are generally disposed in a sheet metal enclosure which is often secured by an external hasp and padlock. Since the air vending enclosure contains a certain amount of cash, it is vulnerable to theft and vandalism.

CONCISE EXPLANATION OF PRIOR ART

U.S. Pat. No. 5,359,868 to Fiorenzo L. Villani discloses an automobile anti-theft gas pedal lock having multiple embodiments including an arcuate retaining lock.

U.S. Pat. No. 4,998,423 to Fong S. Hsu discloses a ring-shaped hanging lock with a replaceable core including a casing and a ring-shaped shackle.

U.S. Pat. No. 5,004,180 to Horst Lebrecht discloses a rekeyable shrouded lock having two shell halves.

U.S. Pat. No. 1,490,453 to Yancey Q. Caldwell discloses a padlock having its operating parts entirely housed so as to preclude any possibility of their manipulation by an unauthorized person.

Finally, U.S. Pat. No. 105,691 to Joseph Ingels discloses a ring-hasp padlock having an arcuate retaining bolt encircling its operating parts.

BRIEF DESCRIPTION OF INVENTION

After much research and study into the above mentioned problems, the present invention has been developed to provide a vending machine type enclosure having an integral locking mechanism that is entirely contained within the enclosure and is thus very resistant to theft and vandalism.

The above is accomplished through the provision of a box-like structure having a bottom surface, side walls, and front and back walls, the interior dimensions being of sufficient size to form an envelope about the coin-operated vending apparatus which is disposed within the enclosure.

The top edges of the box-like enclosure are reinforced with stainless steel angle brackets forming a channel about the top peripheral edges of the enclosure into which a slideable stainless steel top may be inserted and secured. The slideable top includes a central flange welded to its interior surface having an aperture into which a ring-shaped lock shackle is passed.

A ring-shaped lock is welded to the inside surface of an end wall of the enclosure and when the slideable top is in position, the ring-shaped lock shackle passes through the aperture in the central flange securing the top in position. A right angle flange integrally formed with the slideable top at one end prevents access to the lock mechanism.

The ring-shaped lock is positioned adjacent an aperture in the front wall to permit the insertion of a key. The enclosure is provided with a plurality of apertures in predetermined locations to permit entry and exit of compressed air lines, electrical lines, ventilation, fasteners for mounting the enclosure and the like.

In view of the above it is an object of the present invention to provide a tamper-resistant enclosure for a coin operated vending apparatus.

Another object of the present invention is to provide an enclosure for a vending apparatus and the like that is fabricated from corrosion resistant stainless steel and is suitable for an outdoor environment.

Another object of the present invention is to provide a vending machine enclosure which utilizes a commercially available locking mechanism that will facilitate manufacturing.

Another object of the present invention is to provide a locking mechanism which may be adapted to any application where a secure, corrosion-resistant enclosure is desired.

Other objects and advantages of the present invention will become apparent and obvious from a study of the following description and the accompanying drawings which are merely illustrative of such invention.

DETAILED DESCRIPTION OF INVENTION

With further reference to the drawings, the enclosure of the present invention, indicated generally at 10, for vending machines and other means includes a bottom surface 11 and a pair of parallely disposed side walls 12, a back end wall 13*a* and a front end wall 13*b*.

Figure 1:
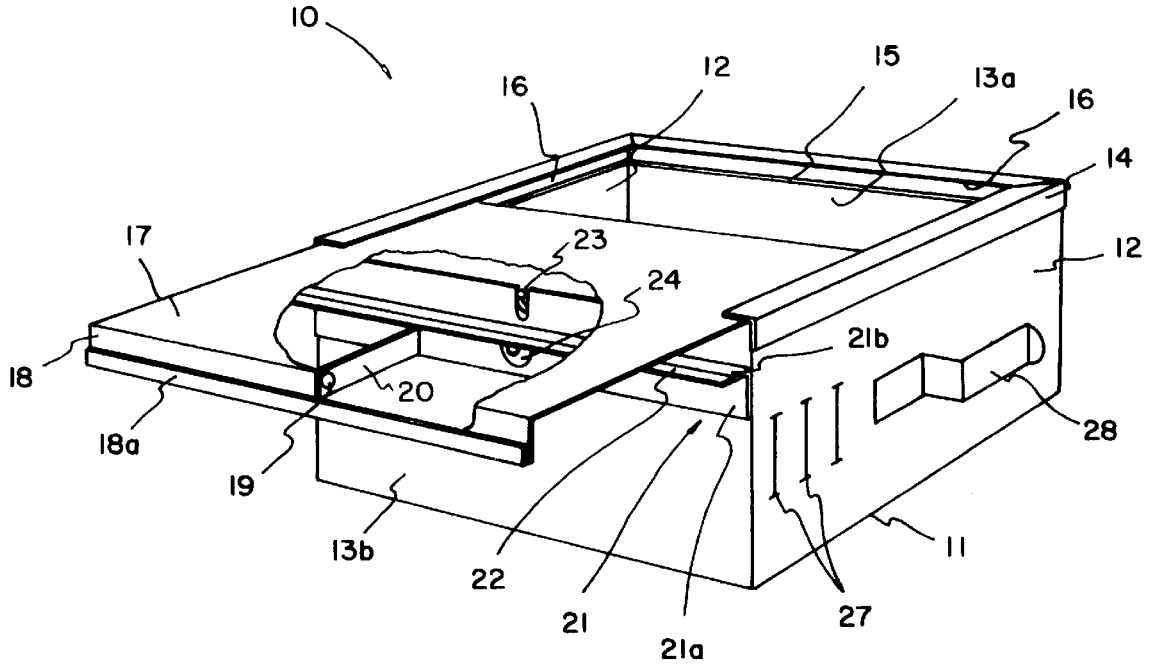
FIG. 1 is a perspective view of the compressed air vending machine enclosure of the present invention including a cutaway section of the slideable top showing the locking mechanism.

The parallely disposed side walls 12 and front and back walls 13*a* and 13*b* extend perpendicularly from bottom surface 11 and are integrally formed therewith into a box-like structure having a top opening as shown in FIG. 1.

The top edge of side walls 12, back wall l3*a*, and front wall 13*b* include a lip 15 integrally formed therewith by bending a predetermined length of the top edge of the side walls 12 and end walls 13*a* and 13*b* perpendicularly toward the interior of the enclosure 10.

Right angle members 14 are attached by weldment or other suitable means to the exterior, top edge of side walls 12 and back wall 13*a* and are positioned in parallel, spaced apart relation to lip 15 about the entire length of the top edge side walls 12 and back wall 13*a* forming channel 16 into which slideable top 17 will be installed.

Right angle members 14 are mitered at the corner junctions with back wall 13*a*. The mitered joints are welded for additional strength.

Slideable top 17 includes a protective flange 18 integrally formed therewith and extending perpendicularly in a downward direction from top 17. Protective flange 18 includes a reinforced flange edge 18*a* integrally formed therewith by folding a predetermined length of a distal edge of protective flange 18 onto itself in a hem effectively doubling its thickness as shown in FIG. 1, and in FIGS. 4 and 5 in detailed cross-sectional view.

Slideable top 17 includes a locking flange 20 that is centrally disposed on an interior surface of slideable top 17 adjacent an interior surface of protective flange 18 and is secured thereto by weldment or by other suitable means. Locking flange 20 includes an aperture 19 having a center axis perpendicular to the plane defining flange 20. Aperture 19 is positioned in a predetermined location adjacent an interior surface of protective flange 18 to accommodate a locking device of the type hereinafter described.

Figure 4:
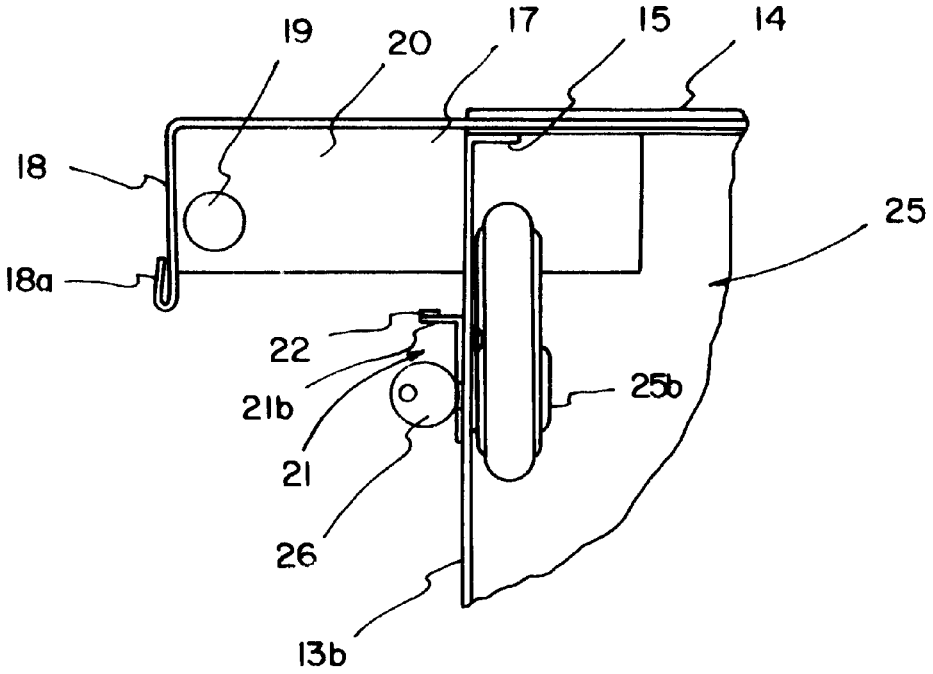
FIG. 4 is a side elevational view of the locking mechanism with the key in an unlocked position viewed through a cutaway section of a side wall of the enclosure.
Figure 5:
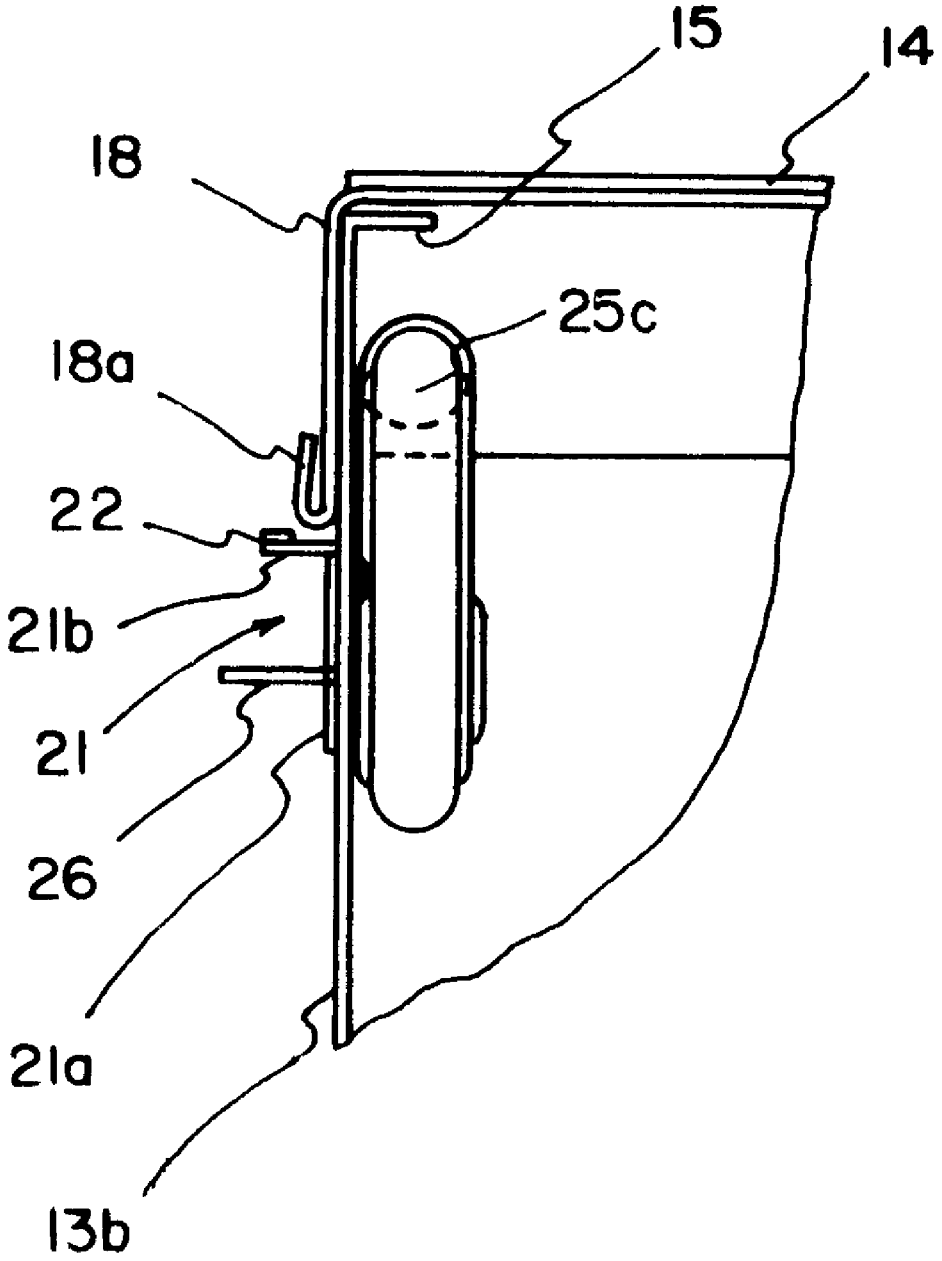
FIG. 5 is a side elevational view of the locking mechanism with the key in a locked position viewed through a cutaway section of a side wall.

As shown in FIGS. 4 and 5, the exterior surface of front wall 13*b* is provided with an L-shaped top support bracket, indicated generally at 21, having a long member 21*a* welded or otherwise mounted juxtaposed to front 13*b* and a short member 21*b* which projects outwardly therefrom.

Top support bracket 21 is positioned in parallel relation to lip 15 at the top edge of front wall 13*b*. Top support bracket 21 is located at a predetermined length from the top edge of front wall 13*b* that is approximately equal to the width of protective flange 18 such that bracket 21 provides a support for flange 18 when slideable top 17 is in a closed position, as shown in FIG. 5.

Short member 21*b* of top support bracket 21 is provided with a strike plate 22, as shown in FIG. 5, which is integrally formed with a distal end of short member 21*b* of top support bracket 21 by folding a predetermined length of short member 21*b* onto itself to form a hem for added strength. Thus, wh en slideable top 17 is moved to a closed position, the interior surface of reinforced flange edge 18*a* will come into contact with strike plate 22 and be lifted slightly to a closed position above the top surface of short member 21*b* of top support bracket 21.

Referring again to FIG. 1, it will be appreciated that front wall 13*b* includes a U-shaped slot 23 that is positioned in substantial linear alignment with locking flange 20 to permit the same to pass into U-shaped slot 23 when slideable top 17 is in a closed position.

Top support bracket 21 includes a keyhole aperture 24 that is centrally disposed on the long member 21*a* of top support bracket 21 as shown in FIG. 1. It will be appreciated that keyhole aperture 24 is in substantial vertical alignment with U-shaped slot 23 at a predetermined position therefrom as shown in FIG. 1.

Figure 2:
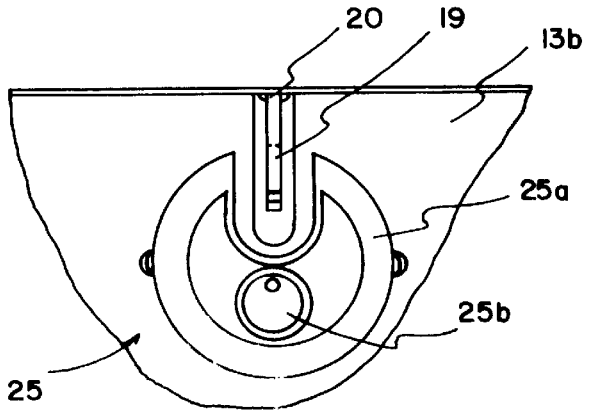
FIG. 2 is an elevational view of the locking mechanism of the present invention in an unlocked position and mounted on an interior end wall of the enclosure.

Referring now to FIG. 2, a ring-shaped hanging lock, indicated generally at 25, including a casing 25*a*, and a rekeyable core 25*b*, is illustrated. Ring-shaped lock 25 includes a ring-shaped shackle 25*c*, as shown in FIG. 3.

Figure 3:
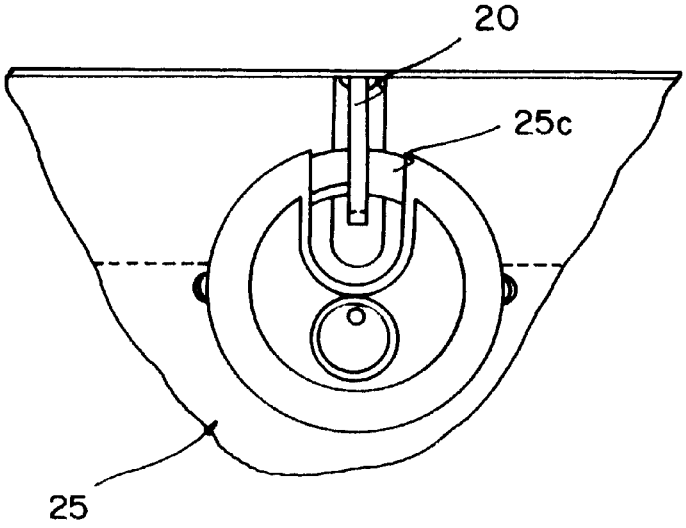
FIG. 3 is an elevational view of the locking mechanism of the present invention in a locked position and mounted on an interior end wall of the enclosure.

Ring shaped lock 25 is disposed on the interior surface of front wall 13b and attached thereto by weldment or other suitable means in substantial vertical alignment with U-shaped slot 23 such that ring-shaped shackle 25*c* may pass through aperture 19 in locking flange 20 when slideable top 17 is in a closed position and lock 25 is secured as shown in FIG. 3.

A ring-shaped lock of the type disclosed in U.S. Pat. No. 4,998,423 to Fong S. Hsu and U.S. Pat. No. 5,044,180 to Horst Lebrecht or other commercially available ring-shaped locks may be utilized in the fabrication of the present invention. Since such ring-shaped locks are well known in the prior art, further detailed discussion of the same is not deemed necessary.

A ring-shaped lock 25 is ideally suited to this application in that the locking mechanism may be operated by a key 26 inserted through keyhole aperture 24 from the exterior of the enclosure as illustrated in FIG. 4 and FIG. 5.

Enclosure 10 may be provided with apertures extending through side walls 12 or end walls 13*a* and 13*b* as necessary to accommodate the apparatus contained within.

If an air vending machine is mounted in enclosure 10 illustrated in FIG. 1, a plurality of ventilation slots 27 for cooling the compressed air apparatus are provided. Exterior side wall 12 may also include a hose bracket 28 mounted thereon by weldment for hanging a compressed air hose (not shown) used to deliver air to a vehicle's tires or other inflatable items.

It is reiterated that the locking enclosure of the present invention may be adapted to dispense any suitable consumer product or commodity and may be utilized in any application where a secure, corrosion-resistant enclosure is desired.

From the above it can be seen that the present invention provides a durable, tamper-resistant enclosure having an integrally formed locking mechanism for a coinoperated vending apparatus for dispensing compressed air or other suitable consumer products. The present invention is relatively simple to fabricate from stainless steel sheet metal and commercially available ring-shaped locks.

The terms "upper", "lower", "aside", "top", "bottom", "front", "back", "end" and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A protective structure for vending equipment comprising:

an enclosure for attachment to said vending equipment, said enclosure comprising a box-shaped structure having a bottom surface, a pair of parallel side walls and a pair of parallel front and back end walls disposed in perpendicular relation to said bottom surface and being fixedly attached thereto, a top opening, and a channel formed about a top edge of said box-shaped structure, said channel including a pair of parallel, horizontally disposed channel wall members disposed in parallel relation to said bottom surface, said channel being formed by attaching a plurality of right angle members to an exterior surface of said enclosure about said top edge of said side walls and said back end wall in parallel, spaced apart relation to said top edge of said box-shaped structure;

a closure means adapted for closing said top opening and preventing access to said vending equipment, said closure means being adapted for sliding engagement within said channel from an open position to a closed position;

locking means including a ring-shaped shackle being permanently mounted on an interior surface of said front end wall of said enclosure in juxtaposition to a keyhole formed therein, said locking means being positioned in an operative engaging and disengaging relationship with said closure means, said locking means residing completely within said structure and being operable by a key from the exterior thereof enabling said closure means to be releasably secured in said closed position; and a top support bracket being fixedly attached to an exterior surface of said front end wall and positioned in an operative relationship with a protective flange integrally formed with a terminal end of said closure means, said flange including a reinforcing hem formed by folding a pre-determined length of said protective flange onto itself thereby doubling its thickness, said protective flange extending downwardly from and in perpendicular relation to said terminal of said closure means to a position wherein said protective flange rests on an upper surface of said top support bracket in said closed position thereby preventing access to said locking means.

2. The protective structure of claim 1 wherein said right angle members are attached to said top edge of said box-shaped structure by weldment, said right angle members functioning to reinforce said top edge of said box-shaped structure and to prevent vandalism thereof.

3. The protective structure of claim 1 wherein said top support bracket includes a centrally disposed keyhole in substantial alignment with said locking means to permit operation of said locking means from the exterior of said enclosure with said closure means in a closed position.

4. The protective structure claim 1 wherein said side walls and said end walls are provided with a plurality of apertures in predetermined locations to permit ingress and egress of coins, electrical conduit, compressed air lines and mounting fasteners.

5. The protective structure of claim 1 wherein said ring-shaped shackle loosely penetrates an aperture in a centrally disposed locking flange being integrally formed on an interior surface of said closure means enabling said closure means to be releasably secured in said closed position.

6. The protective structure claim 1 wherein said locking means is mounted on an interior surface of said enclosure adjacent a centrally disposed keyhole in a front end wall of said enclosure in substantial alignment therewith enabling said locking means to be alternately locked and unlocked by a key from the exterior of said enclosure.

7. A protective structure for vending equipment comprising:

an enclosure for attachment to said vending equipment, said enclosure having a top opening therein and defining an interior compartment for installation of said vending equipment therein;

a closure means adapted for closing said opening and preventing access to said vending equipment, said closure means including a top cover having a centrally disposed locking flange integrally formed on an interior surface of said cover and extending inwardly in perpendicular relation thereto, said top cover slideably engaging in a channel formed about a top edge of said enclosure, said locking flange passing through a slot centrally disposed in a top edge of a front end wall of said enclosure enabling said top cover to be slideably advanced in said channel to a closed position, said top cover including an integrally formed protective flange that extends downwardly in perpendicular relation to a front edge of said top cover engaging a top support bracket attached to an exterior surface of said front end wall of said enclosure enabling said protective flange to rest on an upper surface of said top support bracket in said closed position preventing access to said locking means; and locking means including a ring-shaped shackle being permanently mounted on an interior surface of said front end wall of said enclosure and juxtapositioned to a keyhole formed therein, said locking means being positioned in an operative engaging and disengaging relationship with said closure means, said locking means residing completely within said structure and being operable by a key from the exterior thereof enabling said closure means to be releasably secured in said closed position.

8. The protective structure of claim 7 wherein said ring-shaped shackle penetrates an aperture in said locking flange enabling said closure means to be releasably secured in said closed position.

9. The protective structure of claim 7 wherein said locking means is mounted on an interior surface of said enclosure adjacent a centrally disposed keyhole in said front end wall of said enclosure in substantial alignment therewith enabling said locking means to be alternately locked and unlocked by a key from the exterior of said enclosure.

* * * * *